US007909059B2

(12) United States Patent
Wehner et al.

(10) Patent No.: US 7,909,059 B2
(45) Date of Patent: Mar. 22, 2011

(54) MOBILE CONCRETE PUMP HAVING AN ARTICULATED MAST

(75) Inventors: Volker Wehner, Rottenburg (DE); Martin Mayer, Reutlingen (DE); Stephan Gelies, Magdeburg (DE); Markus Wolfram, Nuertingen (DE); Wolf-Michael Petzold, Aichwald (DE); Max Schuran, Seevetal (DE)

(73) Assignee: Putzmeister Engineering GmbH, Aichtal (DE)

( * ) Notice: Subject to any disclaimer, the term of this patent is extended or adjusted under 35 U.S.C. 154(b) by 244 days.

(21) Appl. No.: 12/227,908

(22) PCT Filed: May 11, 2007

(86) PCT No.: PCT/EP2007/054557

§ 371 (c)(1),
(2), (4) Date: Dec. 2, 2008

(87) PCT Pub. No.: WO2008/003548

PCT Pub. Date: Jan. 10, 2008

(65) Prior Publication Data

US 2009/0283163 A1 Nov. 19, 2009

(30) Foreign Application Priority Data

Jul. 6, 2006 (DE) ..... 10 2006 031 257

(51) Int. Cl.
*F17D 1/00* (2006.01)
*E04G 21/04* (2006.01)

(52) U.S. Cl. ..... 137/615; 141/387

(58) Field of Classification Search ..... 137/615; 141/387; 417/234
See application file for complete search history.

(56) References Cited

U.S. PATENT DOCUMENTS 4,833,615 A 5/1989 Bitner et al.
(Continued)

FOREIGN PATENT DOCUMENTS

DE 43 06 127 9/1994
(Continued)

OTHER PUBLICATIONS

International Search Report, dated Aug. 2007.

*Primary Examiner* — Kevin L Lee
(74) *Attorney, Agent, or Firm* — Collard & Roe, P.C.

(57) ABSTRACT

The invention relates to an automatic concrete pump with an articulated mast (14) serving as a support for a supply line and with two forward and two backward support extensions (16', 16",18',18") which can be supported on a base platform (32) and which can be lowered from a driving position into a support position, each with a telescopic support leg (30). According to the invention, each support extension comprises one inner support position near to the chassis, and at least one outer support position away from the chassis, which can be freely selected by forming defined support configurations (V,SL,SR,YL,YR,N) for the four support extensions. Further, a control device for the movement of the mast arm is provided which comprises a software program corresponding to the selected support configuration, which program limits the pivot angle of the first bending arm (1) about its bending axis (A) and an associated range of angular rotation of the rotatable head (24) about the vertical axis (22), according to the specification of the selected support configuration.

14 Claims, 4 Drawing Sheets

U.S. PATENT DOCUMENTS

| | | | | |
|---|---|---|---|---|
| 5,640,996 | A | 6/1997 | Schlecht et al. | |
| 5,887,735 | A | 3/1999 | Abel | |
| 6,202,013 | B1 | 3/2001 | Anderson et al. | |
| 6,390,504 | B1 * | 5/2002 | Fetzer | 280/763.1 |
| 6,834,911 | B2 * | 12/2004 | Schillinger et al. | 296/193.07 |
| 6,840,540 | B2 | 1/2005 | Fügel | |
| 6,871,667 | B2 | 3/2005 | Schwing et al. | |
| 7,654,286 | B2 * | 2/2010 | Fuegel | 137/615 |
| 2007/0090612 | A1 | 4/2007 | Gelies | |

FOREIGN PATENT DOCUMENTS

| | | |
|---|---|---|
| DE | 100 32 622 | 1/2002 |
| DE | 101 06 427 | 8/2002 |
| DE | 103 20 382 | 12/2004 |
| DE | 103 49 234 | 5/2005 |
| EP | 1 356 910 | 10/2003 |
| EP | 1 710 198 | 10/2006 |
| WO | WO 2005/042319 | 5/2005 |

* cited by examiner

MOBILE CONCRETE PUMP HAVING AN ARTICULATED MAST

CROSS REFERENCE TO RELATED APPLICATIONS

This application is the National Stage of PCT/EP2007/054557 filed on May 11, 2007, which claims priority under 35 U.S.C. §119 of German Application No. 10 2006 031 257.0 filed on Jul. 6, 2006. The international application under PCT article 21(2) was not published in English.

BACKGROUND OF THE INVENTION

The invention relates to a mobile concrete pump having a chassis, an articulated mast disposed on a substructure affixed to the chassis, serving as the carrier for a feed line, and having at least three mast arms, the first mast arm of which is articulated onto a rotating head that can be rotated about a vertical axis of the chassis, with a free end, by means of controlling a rotary drive, whereby the mast arms can be pivoted relative to the rotating head and relative to an adjacent mast arm, in each instance, about horizontal articulation axes, by means of controlling related articulation drives, and having two front and two rear support booms, disposed on the substructure affixed to the chassis, which booms can be moved from a travel position into a support position, if necessary partially, each has a telescoping support leg, and can be supported on a substratum, raising the chassis.

The support booms supported on the substratum with their support legs delimit a support quadrangle, when the chassis is raised, having four tipping edges that extend between the adjacent corners, and the center of gravity of the system is not allowed to go beyond these edges, towards the outside, during movements of the mast arm. When the support booms are fully extended and supported, a rotation by the fully unfolded and horizontally oriented mast arm, of 360° by its rotating head, is usually possible, without any risk of tipping. Furthermore, it is fundamentally known, particularly in the case of narrow construction sites, that the support booms are extended and supported only on one side of the chassis, while they are supported on the substratum in their folded-in position on the other side. In this case, there is a restricted work range of the mast towards the side supported by the extended support booms. In the case of telescoping front support legs and pivoting rear support legs, the rotation angle range of the mast arm between the position pointing to the rear, parallel to the chassis, and its position pointing forward amounts to approximately 130°. This restriction in the rotation angle range in the case of narrow support is constantly felt to be a disadvantage in practice.

Proceeding from this, the invention is based on the task of improving the known mobile concrete pump having an articulated mast and support booms, of the type indicated initially, to the effect that even in the case of a restricted support position, as compared with full support, the maneuvering range of the articulated mast can be improved.

SUMMARY OF THE INVENTION

To accomplish this task, the combination of characteristics indicated in claim 1 is proposed. Advantageous embodiments or further developments of the invention are evident from the dependent claims.

The solution according to the invention proceeds from the idea that each support boom has a support position close to the chassis and at least one support position away from the chassis, which positions can be freely selected for the four support booms, forming defined support configurations. With every support configuration, only those mast arm movements are allowed at which the center of gravity of the machine moves within the tipping quadrangle, in other words within the tipping edges, without the risk of improper operation. In order to achieve this, it is proposed, according to the invention, that a control device for the mast arm movement is provided, which has a software routine or restriction circuit that responds to the support configuration selected, which restricts the pivot angle range of the first mast arm about its articulation axis, and restricts a related rotation angle range of the rotating head about its vertical axis, in accordance with the selected support configuration.

Another advantageous embodiment of the invention provides that at least one of the mast arms consists of two telescope segments that can be displaced in the direction of the arm. It is practical, in this connection, if the first and/or the last mast arm is composed of two telescope segments. In this case, the software routine according to the invention or the restriction circuit restricts the pivot range of the first mast arm and/or the telescoping path of the first and/or last mast arm, as well as a related rotation angle range of the rotating head about its vertical axis, in accordance with the support configuration selected.

In advantageous manner, for this purpose, a selection switch having multiple switch positions that correspond to the different support configurations is provided, whereby the control device for the mast arm movement responds to the switching positions of the selection switch.

An expansion in the rotation angle range can be achieved, in the case of articulated masts having at least four mast arms, in that the control device for the mast arm movement has a subroutine or restriction circuit that responds to the support configuration selected, which restricts not only the pivot angle of the first mast arm, but also the pivot angle of the second mast arm about its articulation axis. Analogously, a further expansion in the case of articulated masts having at least five mast arms is possible, if the control device for the mast arm movement has a subroutine or restriction circuit that responds to the support configuration selected, which also restricts the pivot angle of the third mast arm about its articulation axis. It is practical if the restriction circuit that is alternatively provided has at least one end switch.

In practical use, the invention is particularly seen as being that the control device for the mast arm movement has a locking device that locks the articulation drive of the first mast arm in its position oriented essentially parallel to the vertical axis. The expansions indicated above, for mast arms having at least four and five arms, consist in the fact that the control device for the mast arm movement has a locking device that locks the articulation drive of the second mast arm, and, if applicable, also of the third mast arm, in their position aligned with the first mast arm. It is practical if the locking device that is alternatively provided has at least one end switch.

Using the measures according to the invention, the result is achieved that by locking the first mast arm and, if applicable, any other mast arms, in their orientation parallel to the vertical chassis axis, a reduction in the center of gravity circles during rotation of the articulated mast about the vertical axis results, which yields an expanded work range in the angle of rotation even in the case of restricted support configurations, which range can amount to as much as 360° in the case of appropriate coordination between support configuration and arm locking.

Another advantageous embodiment of the invention provides that the control device has a software routine or a restriction circuit that responds to the support configuration that was input, and to the pivot angle of the first mast arm, and selects the rotation range of the rotating head in accordance with these data. A further improvement in this regard is achieved if the software routine or the restriction circuit additionally responds to the pivot angle of the second mast arm when the first mast arm is oriented essentially parallel to the vertical axis, and selects the rotation range of the rotating head for this. A further improvement is achieved if the software routine or the restriction circuit additionally responds to the pivot angle of the third mast arm when the first and second mast arm are oriented essentially parallel to the vertical axis, and selects the rotation range of the rotating head for this. It is practical if the restriction circuit that is alternatively provided has at least one end switch.

BRIEF DESCRIPTION OF THE DRAWINGS

In the following, the invention will be explained in greater detail using exemplary embodiments shown schematically in the drawing. This shows.

DETAILED DESCRIPTION OF THE INVENTION

Figure 1A:
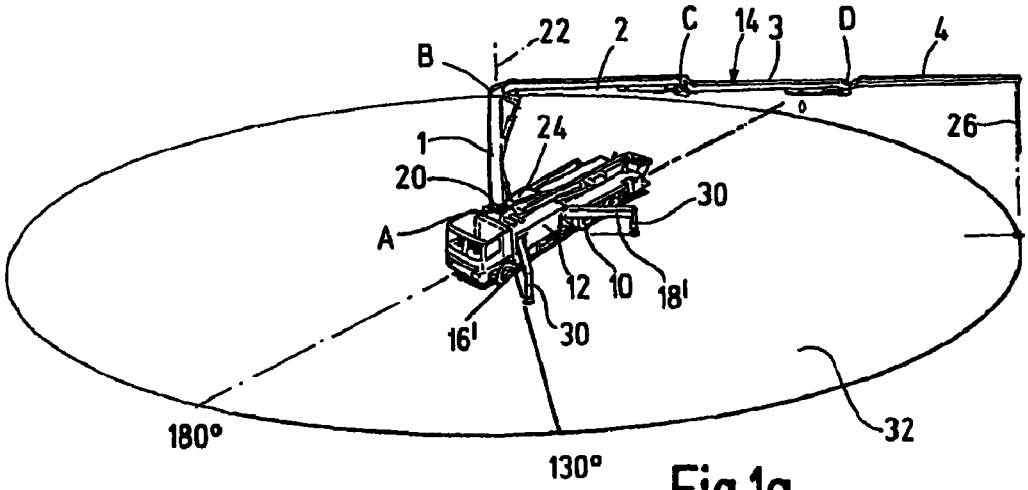
FIG. 1*a* to *c* a schematic relating to determining the work range of the mast movement of a mobile concrete pump in the case of three different support and mast arm configurations.
Figure 1B:
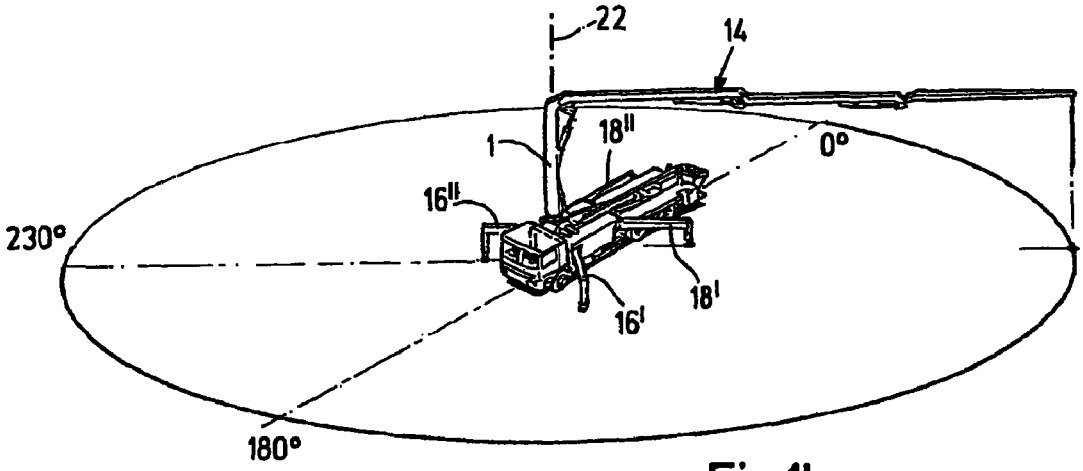
Figure 1C:
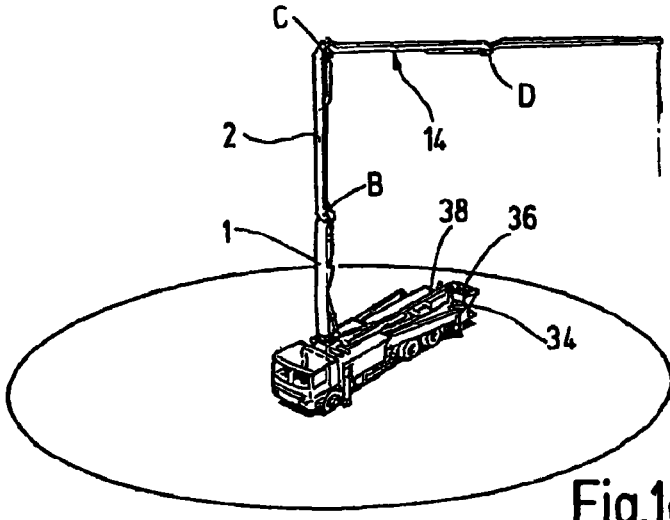

The mobile concrete pump shown in FIG. 1*a* to *c* comprises a chassis 10, a four-arm articulated mast 14 disposed on a substructure 12 affixed to the chassis, serving as the carrier for a feed line, as well as two front support booms 16', 16" and two rear support booms 18', 18". In the case of the exemplary embodiment shown, the articulated mast 14 has four mast arms 1, 2, 3, 4. In this connection, the first mast arm 1 is articulated onto a rotating head 24 that can be rotated about a vertical axis 22 of the chassis 10, with its one end 20, by means of controlling a rotary drive. For the remainder, the mast arms 1, 2, 3, 4 can be pivoted relative to the rotating head 24 and relative to an adjacent mast arm, in each instance, about horizontal articulation axes A, B, C, D, by means of controlling related articulation drives. The last mast arm 4 carries an end hose 26 at its free end, which hose is connected with the feed line, not shown.

The front support booms 16', 16" can be telescoped, relative to the substructure 12 affixed to the chassis, from a retracted travel position into an extended support position that points forward at a slant. The two rear support booms 18', 18" can be pivoted about an axis 28 fixed in place on the chassis, from a travel position oriented essentially parallel to the chassis into a support position that points backward at a slant. Furthermore, all the support booms 16', 16", 18', 18" have a telescoping support leg 30, with which they can be supported on a substratum 32, raising the chassis 10. In the rear region of the chassis 10, there is a hydraulically operated thick-matter pump 34, which transports the liquid concrete filled in by way of an application container 36 along the chassis and the articulated mast 14 to the end hose 26, by way of the feed line 38.

Depending on the space requirements at the construction site, the support booms can optionally be supported in an inner support position close to the chassis, or an outer support position away from the chassis, with their support legs on the substratum, forming different extension configurations.

Figure 2:
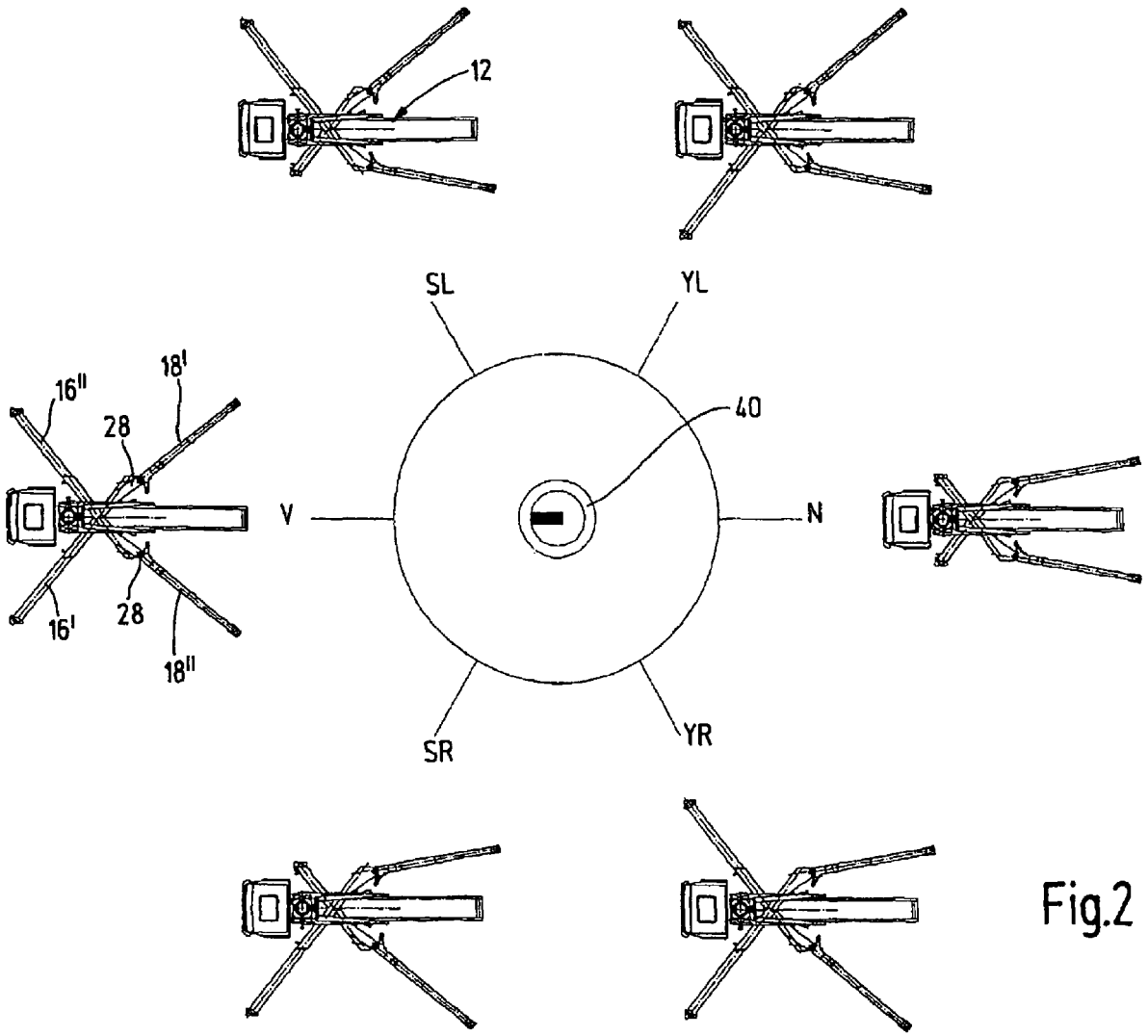
FIG. 2 a selection switch for selecting different support configurations of a mobile concrete pump.

In the case of the exemplary embodiment according to FIG. 2, six support configurations that can be selected by way of a selection switch 40 are provided, namely one full support V, one narrow support SL (left) and SR (right), in each instance, one Y support YL (left) and YR (right), in each instance, and one near support N.

In this connection, the full support V is selected in such a way that the mast charged with liquid concrete can be rotated, in the extended horizontal position, about the vertical vehicle axis 22, in a rotation range of 360° of the rotating head 24, without any risk of tipping.

In the case of the narrow supports SL and SR according to FIG. 2, the permissible work range for the mast movement towards the support side is restricted to a defined rotation angle range. The permissible rotation range of the articulated mast in the case of a fully extended articulated mast, also at the mast arm 1, amounts to between 0° and 130° for the support configuration SL shown in FIG. 1*a*. This angle range can be expanded to 180° in the case of the support configuration SL in question if the first mast arm 1 is locked in place in its position shown in FIG. 1, essentially parallel to the vertical axis 22.

A further increase in the permissible work range is achieved, according to FIG. 1*b*, in that the front right support boom 16" is also extended, forming the support configuration YL. In this case, the rotation angle range with the articulated mast extended amounts to 230° at the first mast arm, as well. It can be extended slightly further if, in addition, as shown in FIG. 1*a*, the first mast arm 1 is locked in its vertical position.

In FIG. 1*c*, the rotation range for the case of the support configuration N (near position) is shown, in which all four support booms 16', 16", 18', 18" are supported with their support legs 30 on the substratum 32 in an inner position, close to the chassis. In this case, stable support is obtained only if not only the first mast arm 1 but also the second mast arm 2 are locked in their vertical position. In this case, the rotation range amounts to 360°, with a correspondingly reduced work radius.

The mobile concrete pump comprises a control device for the mast arm movement, which responds to the switching positions of the selection switch 40 for the various support configurations. The control device is computer-assisted. The two flow charts according to FIGS. 3*a* and *b* are intended to illustrate the functioning of the control device in monitoring the mast arm movement.

Figure 3A:
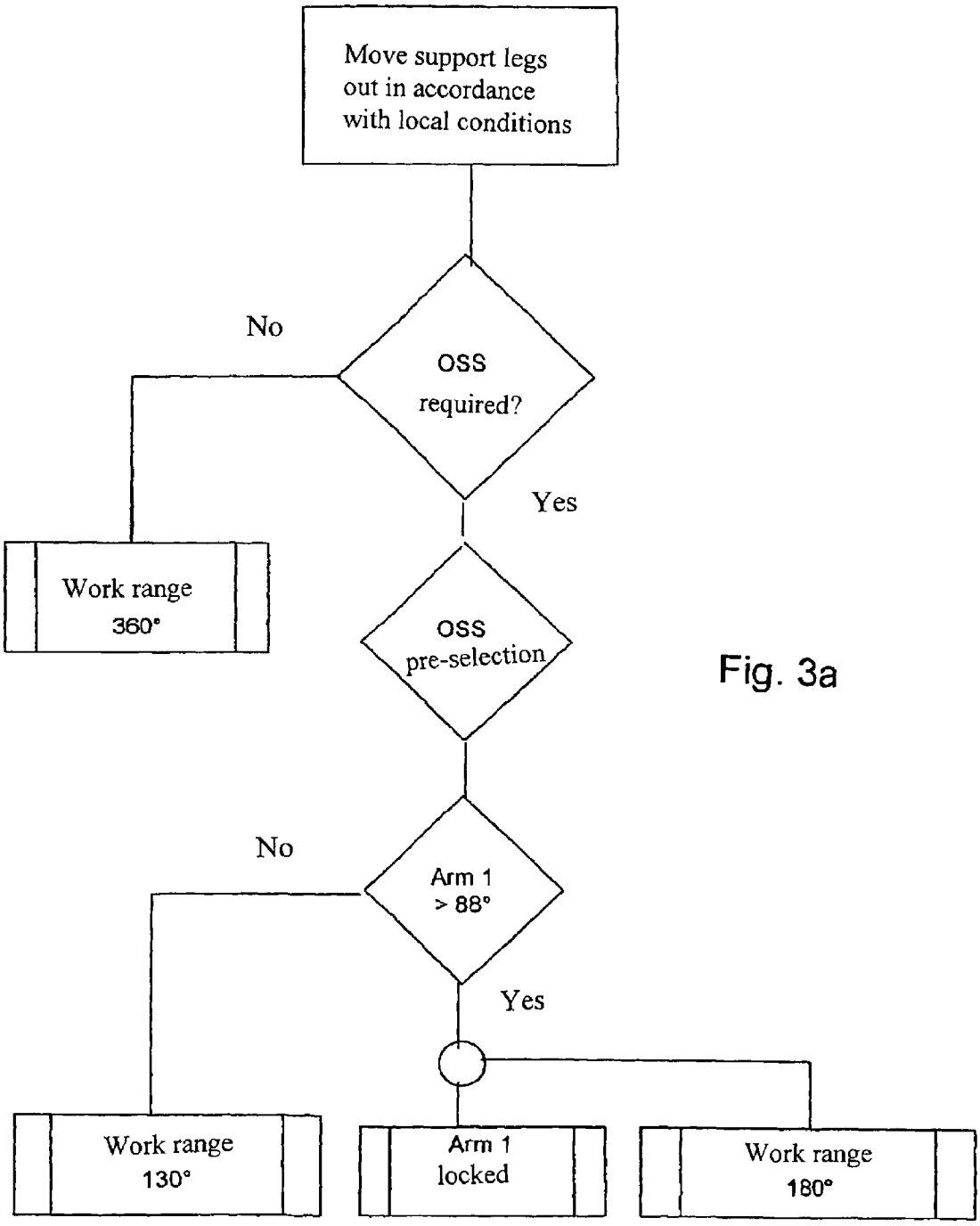
FIG. 3*a* a flow chart of a software routine for restricting the work range in the case of narrow support on one side.

The flow chart according to FIG. 3*a* shows the work method of a software routine of the control device for the case of one of the narrow supports LS and SR, which are indicated there with the abbreviation "OSS" [one-sided support]. If the pump operator at the construction site decides, when extending the support legs in accordance with the local conditions, that a narrow support is required (OSS required?), a restricted work range occurs as compared with the work range of 360° that is decisive for full support. For this purpose, the related arm configuration (here, SL or SR) must first be selected, by way of the selection switch 40. As long as the mast arm 1 has an articulation angle ≦88° at the articulation axis A, the work range is restricted to 130° by way of the control device. A larger work range can be set in that the arm 1 is brought into its position essentially parallel to the vertical axis (angle about the articulation axis >88°). There, the arm can be locked in place, and thus the work range can be expanded to 180° (cf.

also FIG. 1*a*). The work ranges of 130° and 180°, respectively, must also be taken into consideration when folding the articulated mast back in.

Figure 3B:
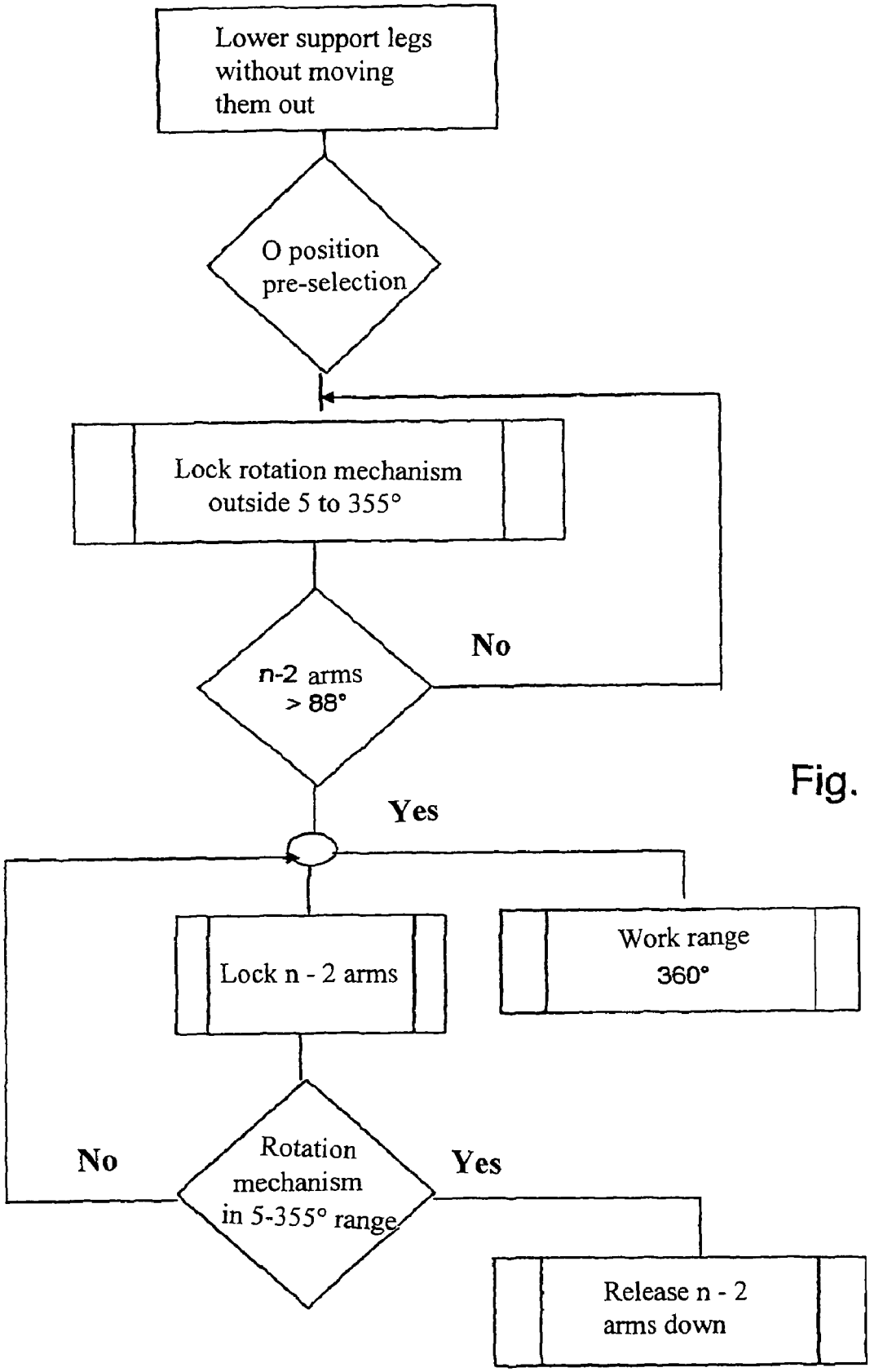
FIG. 3*b* a flow chart of a software routine for establishing the work range in the case of support of the support legs in the non-extended state of the support booms, close to the chassis.

The flow chart according to FIG. 3*b* illustrates the method of procedure when using the arm configuration N (FIG. 2), in other words if all the support booms are supported on the substratum in their inner position, close to the chassis (cf. also FIG. 1*c* in this regard).

When the support legs are supported in the work configuration N, and after pre-selection of the selection switch 40 to the position N, at first the rotating head is locked outside of the angle range 5° to 35°. If, in the case of n=4 mast arms, the first and second mast arm (n−2=2) are brought into the vertical position (>88°), the two arms 1 and 2 can be locked, and the rotation range can be expanded to 360°. Release of the first or second arm is only possible if the rotating head with the articulated mast is oriented essentially in the longitudinal direction of the vehicle, in the range of 0 to 5° and 35° to 360°. In this position the articulated mast can also be folded back into its travel position.

Fundamentally, it is possible that at least one of the mast arms consists of two telescope segments that can be displaced in the longitudinal direction of the arm. In this connection, the first mast arm or the last mast arm, for example, can be configured as a telescope arm. In this case, the software routine or the movement circuit restricts the pivot range of the first mast arm about the articulation axis A and/or the telescoping movement of the first and/or last mast arm, as well as a related rotation angle range of the rotating head about its vertical axis, in accordance with the selected support configuration.

In summary, the following should be stated: The invention relates to a mobile concrete pump having an articulated mast 14 that serves as a carrier for a feed line, and having two front and two rear support booms 16', 16", 18', 18" that can be moved from a travel position into a support position, each having a telescoping support leg 30, which booms can be supported on a substratum 32. According to the invention, each support boom has an inner support position close to the chassis, and at least one outer support position away from the chassis, which positions can be freely selected for the four support booms, forming defined support configurations V, SL, SR, YL, YR, N. Furthermore, a control device for the mast arm movement is provided, which has a software routine that responds to the support configuration selected, which restricts the pivot angle of the first mast arm 1 about its articulation axis A, and restricts a related rotation angle range of the rotating head 24 about the vertical axis 22, in accordance with the selected support configuration.

The invention claimed is:

1. Mobile concrete pump having a chassis, an articulated mast disposed on a substructure affixed to the chassis, serving as the carrier for a feed line, and having at least four mast arms comprising first, second, third, and fourth mast arms, the first mast arm being articulated onto a rotating head that can be rotated about a vertical axis of the chassis, with its one end, by controlling a rotary drive, whereby the mast arms can be pivoted relative to the rotating head and relative to an adjacent mast arm, in each instance, about horizontal articulation axes, by controlling related articulation drives, having two front and two rear support booms, disposed on the substructure affixed to the chassis, which booms can be moved from a travel position into a support position, if necessary partially, each have a telescoping support leg, and can be supported on a substratum, raising the chassis, whereby each support boom has a support position close to the chassis and at least one support position away from the chassis, which positions can be freely selected for the four support booms, forming defined support configurations, and having a control device for the mast arm movement that has a software routine or restriction circuit that responds to the support configuration selected, wherein a selection switch having multiple switching positions corresponding to different support configurations is provided, wherein the control device for the mast arm movement responds to the switching position of the selection switch and restricts the pivot angle range of the first mast arm about its articulation axis, and restricts a related rotation angle range of the rotating head about its vertical axis, in accordance with the selected support configuration.

2. Mobile concrete pump according to claim 1, whereby the articulated mast has at least four mast arms, wherein the control device for the mast arm movement has a subroutine or restriction circuit that responds to the support configuration selected, which restricts not only the pivot angle of the first mast arm, but also the pivot angle of the second mast arm about its articulation axis.

3. Mobile concrete pump according to claim 1, whereby the articulated mast has at least five mast arms, wherein the control device for the mast arm movement has a subroutine or restriction circuit that responds to the support configuration selected, which also restricts the pivot angle of the third mast arm about its articulation axis.

4. Mobile concrete pump according to claim 1, wherein the control device for the mast arm movement has a locking device that locks the articulation drive of the first mast arm in its position oriented essentially parallel to the vertical axis.

5. Mobile concrete pump according to claim 1, wherein the control device for the mast arm movement has a locking device that locks the articulation drive of the second mast arm in its position aligned with the first mast arm.

6. Mobile concrete pump according to claim 5, wherein the control device for the mast arm movement has a locking device that locks the articulation drive of the third mast arm in its position aligned with the second mast arm.

7. Mobile concrete pump according to claim 1, wherein the control device has a software routine or restriction circuit that responds to the support configuration that was input, and to the pivot angle of the first mast arm, and selects the rotation range of the rotating head in accordance with the support configuration that was input and the pivot angle of the first mast arm.

8. Mobile concrete pump according to claim 7, wherein the software routine or the restriction circuit additionally responds to the pivot angle of the second mast arm when the first mast arm is oriented essentially parallel to the vertical axis, and selects the rotation range of the rotating head for the pivot angle of the second mast arm.

9. Mobile concrete pump according to claim 8, wherein the software routine or the restriction circuit additionally responds to the pivot angle of the third mast arm when the first mast arm and the second mast arm are oriented essentially parallel to the vertical axis, and selects the rotation range of the rotating head for the pivot angle of the third mast arm.

10. Mobile concrete pump according to claim 4, wherein at least one of the restriction circuit and the locking device has at least one end switch.

11. Mobile concrete pump according to claim 1, wherein at least one of the mast arms comprises two telescope segments that can be displaced in the longitudinal direction of the arm.

12. Mobile concrete pump according to claim 11, wherein the first mast arm comprises two telescope segments.

13. Mobile concrete pump according to claim 11, wherein the fourth mast arm comprises two telescope segments.

14. Mobile concrete pump according to claim 11, wherein the software routine or the restriction circuit restricts the pivot angle range of the first mast arm and/or the telescoping path of the first and/or fourth mast arm, as well as a related rotation angle range of the rotating head about its vertical axis, in accordance with the support configuration selected.

* * * * *